United States Patent [19]

Wolf

[11] Patent Number: 4,705,246

[45] Date of Patent: Nov. 10, 1987

[54] BAG FRAME

[76] Inventor: William Wolf, 116 Massachusetts Ave., Congers, N.Y. 10920

[21] Appl. No.: 812,800

[22] Filed: Dec. 23, 1985

[51] Int. Cl.[4] ..... B65B 67/12

[52] U.S. Cl. ..... 248/97; 220/403

[58] Field of Search ..... 248/97, 99, 95, 100, 248/101; 220/402, 403; 232/1 B

[56] References Cited

U.S. PATENT DOCUMENTS

| | | | |
|---|---|---|---|
| 3,226,015 | 12/1965 | Manfredonia | 248/101 X |
| 3,598,350 | 8/1971 | Kaufman | 248/97 |
| 3,796,402 | 3/1974 | Trotta | 248/97 |
| 3,893,615 | 7/1975 | Johnson | 248/95 X |
| 4,054,225 | 10/1977 | Frech | 220/403 X |
| 4,157,801 | 6/1979 | Elmer | 248/97 |
| 4,442,567 | 4/1984 | Pravettone | 248/99 X |
| 4,537,376 | 8/1985 | Buku | 248/97 |

*Primary Examiner*—J. Franklin Foss
*Assistant Examiner*—David L. Talbott
*Attorney, Agent, or Firm*—Robert A. Hirschfeld

[57] ABSTRACT

The opening of a bag is defined by a bag frame which in laid down position allows debris to be directly swept into the bag, and in upright position to allow further expansion of the bag beyond a size withdrawable through the opening. A side panel releasably permits the overfilled bag to be withdrawn from the frame, and also provides abrasion/puncture resistance intermediate the bag and the work surface, allowing the bag and frame to be dragged to a convenient location.

6 Claims, 5 Drawing Figures

BAG FRAME

BACKGROUND OF THE INVENTION

1. Technical Field

The invention relates to frames for supporting bags to facilitate filling.

In particular, the invention relates to a frame which defines an opening for the supported bag suitable for sweeping or raking from a horizontal work surface, said frame being emplaceable uprightly for holding and release of a bag whose filled dimensions exceed that of the filling opening.

2. Prior Art

Disposable, lightweight bags are increasingly being used for containing swept or raked debris such as leaves from a ground, or work surface. A common usage is to use such bags to line a large canister, folding the open end for support over the open end of the canister, and picking up debris in batches to dump into the bag. If the canister has at least one flat side, the canister containing the bag may be set on its side and debris swept directly into it. The amount of debris collectible by such method is limited to that corresponding to the interior volume of the supporting canister, which is usually a cylindrical elongation of the canister opening shape. The actual capacity of the bag is generally greater than that of the canister, because the bag is capable of bulging outward, and in its most efficient form where surface stress is uniform, would be in an approximately spherical or oblate spherical bag shape, with the bag opening being constricted by a bag tie, string, tape or the like for subsequent transport and storage.

When an opening is defined by a supporting structure, suitable for directly sweeping into the bag, such opening is generally unsuitable for withdrawing the overfilled bag therethrough.

It is desirable to withdraw the overfilled bag through the side of a bag frame; yet when the frame is laid on its side so that debris can be directly swept into the opening, it is also desirable that there be protection from abrasion and puncture of the disposable bag.

Therefore, it is an object of the invention to provide a bag frame for supporting a bag in both upright and horizontal position on a work surface.

Another object of the invention is to provide a bag frame which defines a bag opening suitable for direct sweeping of debris into the bag when the frame is laid down upon the work surface.

A further object of the invention is to provide a bag frame in which the bag may be filled to a greater dimension than fits through the filling opening, and in which the overfilled bag may be removed from the frame other than through the filling opening defining portion.

Still another object of the invention is to provide a bag frame having protection for the bag against abrasion or puncture of the bag when positioned for direct sweeping into the bag from the work surface.

Yet another object of the invention is to provide a bag frame which is easily disassembled for storage or transport.

A still further object of the invention is to provide a bag frame which is easily collapsed into a compact storage or transport condition when not being used to support a bag.

DISCLOSURE OF THE INVENTION

A bag frame is disclosed which is freestanding in upright position, having a filling ring supported through one or more struts by a base ring. In a preferred embodiment, the filling ring and base ring each have a straight side portion, respectively referred to as the filling bar and the base bar, which two bars are parallel to each other forming a plane substantially orthogonal the work surface when the frame is upright. A sturdy flexible panel, of canvas and the like, is detachable coupled at its transverse edges to the filling and base bars by snaps and the like.

A conventional garbage or leaf bag is supported in the upright condition by being looped or folded over the filling bar. The frame containing the bag may then be laid down with the straight filling bar and base bar resting upon the work surface, and the bag supported through the flexible panel by the work surface, with the bag opening being held open by the filling ring. As more and more debris is swept into the bag, the sides of the bag may expand or bulge outward beyond the confines of the frame, and to a larger dimension than that defined by the filling ring. Thereafter, the frame and bag may be tipped upright, and even more debris stuffed down through the bag opening, causing even greater distension or bulging of the bag.

To remove the overfilled bag from the frame, the flexible panel is released, and the bag is withdrawn from the side of the frame corresponding to the plane defined by the parallel straight filling bar and base bar.

In one embodiment, the struts are detachable, so that the frame may be disassembled into a compact space suitable for storage or shipment. In another embodiment, the struts are hinged with respect to the base ring and filling ring, so that the whole frame may be collapsed into a compact space for storage or shipment.

In other embodiments, retention of the bag is accomplished by circumscribing the bag with releasable rope, string, wire, tape, strap, or by enclosing the bag frame and contained bag in a sturdy sack of canvas and the like, whose opening coincides with the bag opening defined by the filling ring.

BEST MODE FOR CARRYING OUT THE INVENTION

Figure 1:
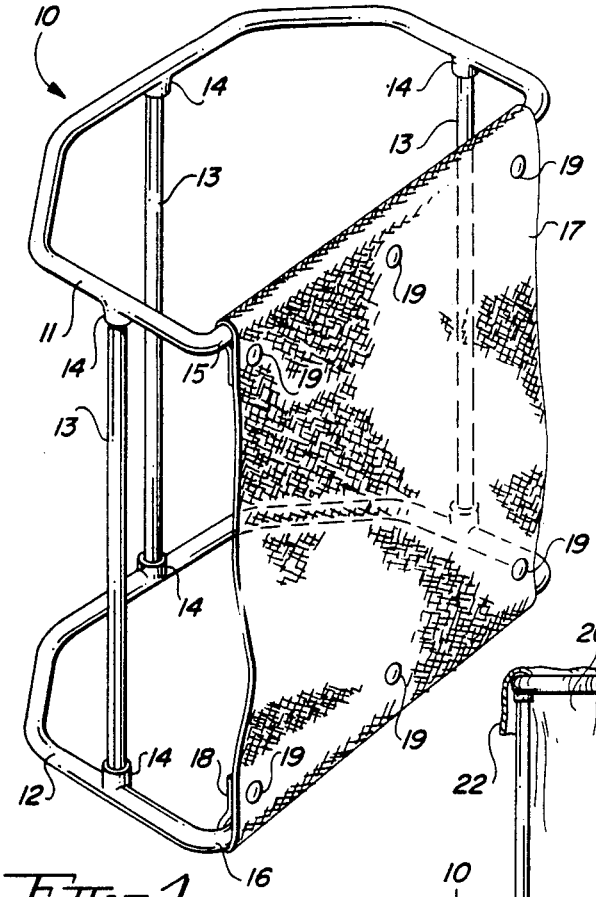
FIG. 1 is a perspective view of the bag frame, in upright condition, prior to bag insertion.

For the purpose of promoting an understanding of the principles of the invention, reference will now be made to embodiments illustrated in the drawings. Specific language will be used to describe the same. It will, nevertheless, be understood that no limitation of the scope of the invention is thereby intended, such alterations and further applications of the principles of the invention as illustrated herein being contemplated as would normally occur to one skilled in the art to which the invention relates.

FIG. 1 illustrates in perspective view a preferred embodiment of the bag frame, generally referred to as 10. Filling ring 11 defines the shape and location of an opening to which the opening of bag 20 (seen in FIGS. 3,4,5) will be conformed. Base ring 12 in upright condition rests upon the work surface (not separately indicated, but understood to be the ground, a floor, and the like). Struts 13 releasably engage coupling members 14, at a lower, first end to base ring 12 and at an upper, second end to filling ring 11, such that the spaced relationship between base ring 12 and filling ring 11 is rigidly defined. Although said rings 11,12 are shown in the drawings to be approximately parallel, for some sweeping applications it may be desired that one or both of rings 11,12 be canted for convenience, and such variation falls within the contemplation of the invention, and may be readily practiced by one skilled in the art without being separately illustrated.

A portion of the periphery of filling ring 11 is defined as straight filling bar 15. A corresponding portion of the periphery of base ring 12 is defined as straight base bar 16, such that bars 15,16 are parallel, defining a plane (not separately indicated) upon which the frame may be laid as shown in FIG. 3 for direct sweeping of debris along the work surface into the bag opening defined by filling ring 11.

Flexible panel 17 is coupled to filling bar 15 and to base bar 16 by wrapping therearound, and releasably held in place by cooperating snaps 19. Preferably, panel 17 is comprised of a tough, resilient material such as canvas or plastic sheeting, so that objects tending to abrade or puncture bag 20 are prevented from coming in contact with bag 20.

Figure 2:
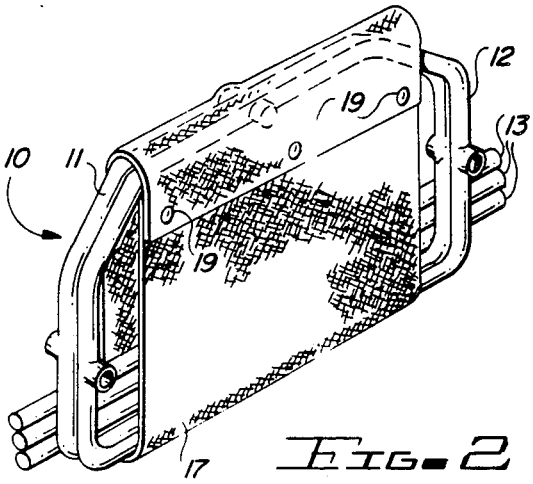
FIG. 2 is a view of the bag frame in disassembled, collapsed condition, in perspective.

When struts 13 are disassembled as in FIG. 2 from filling bar 11 and base bar 12, the bag frame 10 may be conveniently collapsed for storage or transport. In an alternate embodiment (not shown, but which may readily be practiced by those skilled in the art) struts 13 are coupled by hinges (not shown) rather than the socket couplings 14 illustrated, to rings 11,12, such that the frame 10 may be trapezoidally collapsed into a compact space wherein rings 11, 12 are closer together than when in the operative condition illustrated in FIGS. 1,3,4,5.

Figure 3:
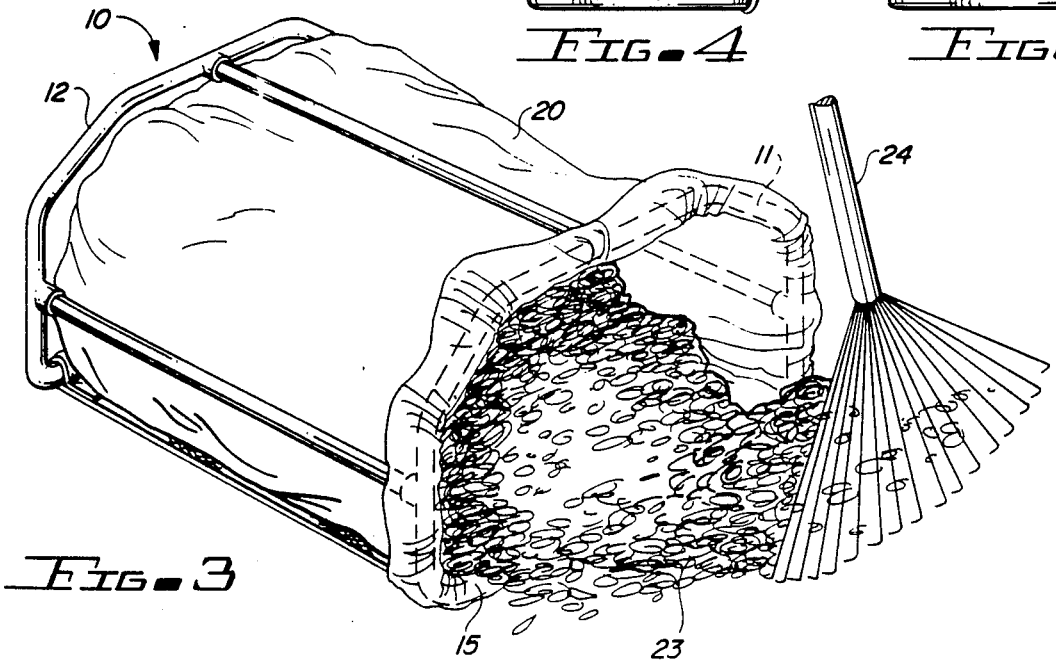
FIG. 3 is a perspective view of the bag frame shown in FIG. 1, with bag inserted, as laid down upon a work surface and partially filled by swept debris.

FIG. 3 illustrates the invention in operation, laid down upon the work surface, with bag 20 conformed over and around filling ring 11. Rake 24 sweeps debris 23 through filling ring 11 into bag 20. Straight filling bar 15 is approximately conformal to the work surface, so that sweeping action urges substantially all debris 3 directly through filling ring 11.

Figure 4:
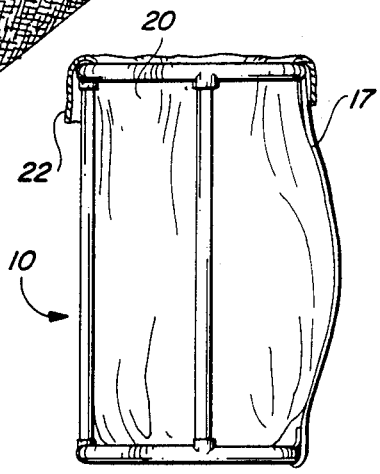
FIG. 4 a side view of the bag frame of FIG. 3 in upright condition, with the overfilled bag bulging against the flexible panel.
Figure 5:
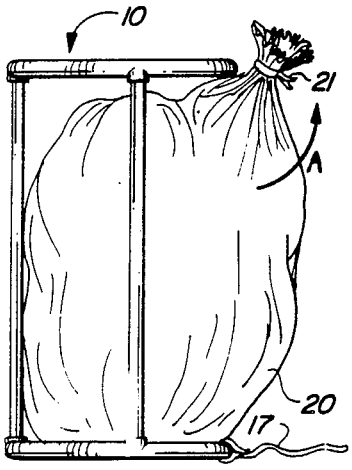
FIG. 5 is view similar to FIG. 4, showing the flexible panel released from the filling ring, the bag closed by a bag tie, and being withdrawn through the opening otherwise covered by the flexible panel.

In FIG. 4, the bag frame 10 with bag 20 is shown upright, with bag 20 held onto filling ring 15 by overlap portion 22 of bag 20. It may be seen in FIGS. 4,5 that overfilled bag 20 will no longer fit through filling ring 15, and must therefore be withdrawn by alternative opening, which is accomplished by releasing at least one set of snaps 19 on flexible panel 17 from closed position shown in FIG. 4 to open position shown in FIG. 5. The bag 20, which most efficiently would assume a nearly spherical shape, is tied off by bag tie 21, and removed in the direction indicated in FIG. 5 by arrow A.

Not illustrated, but readily practicable by one skilled in the art, is bag retention within the general confines of the frame by circumscribing the bag 20 and bag frame 10 with releasable rope, string, wire, tape, strap and the like, which may as known in the art be passed through retention holes (not shown) in appropriate locations along struts 13, and rings 11,12. One skilled in the art may also readily perceive that a tow rope (not shown) may be tied to a convenient portion of the bag frame 10, for dragging the frame and contained bag along work surfaces. Puncture and abrasion protection for bag 20 is provided during such contemplated dragging by interposition of flexible panel 17 between the work surface and bag 20.

In another alternative embodiment (not shown, but readily understandable and practicable by one skilled in the art), a heavy, tough sack surrounding the bag frame's exterior is releasably coupled to filling ring 11 so that the sack opening coincides with the bag 20 opening, thereby performing essentially the same releasable containment and abrasion/puncture resistance function is as illustrated for flexible panel 17. Coupling of the exterior sack to filling ring 11 would be releasably made in a fashion comparable to that by which portion 22 of bag 20 is shown in FIG. 4 to couple the bag opening to filling ring 11.

Those skilled in the art will readily derive other embodiments of the invention drawn from the teachings herein. To the extent that such alternative embodiments are so drawn, it is intended that they shall fall within the ambit of protection provided by the claims appended hereto.

Having described my invention in the foregoing specification and the accompanying drawings in such a clear and concise manner that those skilled in the art may readily understand and easily practice the invention, that which I claim is:

1. A bag frame for facilitating the filling of a bag, said bag having a bag opening, said bag frame comprising:

filling ring means for exteriorly supporting said bag adjacent said bag opening and for defining the shape of said bag opening;

base ring means for supporting said bag frame upon a work surface, said base ring means in spaced relationship to said filling ring means;

strut means for supportingly defining said spaced relationship between said filling ring means and said base ring means, said strut means having first and second ends, said strut means having first and second ends, said first end coupled to said base ring means, said second end coupled to said filling ring means; and bag retainer means releasably coupled to said filling ring means and said base ring means for releasably retaining said bag within said bag frame, wherein said filling ring means is defined along a peripheral portion as a straight filling bar, wherein said base ring means is defined along a peripheral portion as a straight base bar, said straight filling bar is parallel to said straight base bar, said straight filling bar and said straight base bar defining a plane, said bag retainer means substantially within said plane.

2. A bag frame according to claim 1 wherein said filling ring means comprises means for disposing a portion of said bag looped or folded over said straight filling bar into direct in contact with said work surface when said bag frame is laid down upon said work surface, for facilitating the sweeping of debris directly into said bag.

3. A bag frame according to claim 2 wherein said bag retainer means comprises flexible panel means coupled along a first edge to said base bar and along a second edge transverse said flexible panel means from said first edge to said filling bar, said flexible panel means being releasable from at least one of said base bar and said filling bar.

4. A bag frame according to claim 3 wherein said flexible panel means comprises abrasion resistance means for resistance to abrasion of said bag adjacent a plane defined by said parallel base bar and filling bar.

5. A bag frame according to claim 3 wherein said flexible panel means comprises puncture resistance means for resistance to puncture of said bag adjacent a plane defined by said parallel base bar and filling bar.

6. A bag frame according to claim 1 wherein said strut means is releasably coupled to said filling ring means and said base ring means, for disassembly of said bag frame.

* * * * *